United States Patent [19]

Johansen

[11] 4,169,590

[45] Oct. 2, 1979

[54] EXERCISING DEVICE

[76] Inventor: Johan K. Johansen, 9090 Burfjord, Burfjord, Norway

[21] Appl. No.: 901,061

[22] Filed: Apr. 28, 1978

[51] Int. Cl.[2] ..... A63B 21/02

[52] U.S. Cl. ..... 272/142

[58] Field of Search ..... 272/68, 142, 143, 135, 272/67, 130

[56] References Cited

U.S. PATENT DOCUMENTS

| | | | |
|---|---|---|---|
| 1,680,901 | 8/1928 | Meyer | 272/142 X |
| 2,529,347 | 11/1950 | Mohler et al. | 272/137 |
| 3,759,512 | 9/1973 | Young et al. | 272/142 X |
| 4,022,463 | 5/1977 | Scott, Jr. | 272/142 X |
| 4,023,796 | 5/1977 | Kusmer | 272/142 X |

FOREIGN PATENT DOCUMENTS

| | | | |
|---|---|---|---|
| 791616 | 12/1935 | France | 272/142 |

*Primary Examiner*—Richard T. Stouffer
*Assistant Examiner*—Scott L. Brown
*Attorney, Agent, or Firm*—Howson and Howson

[57] ABSTRACT

An exercising device comprising a pair of rods, a connecting member, a pair of pivots each connecting one of the opposite ends of the connecting member to a corresponding one of the rods, and a spring inter-connecting adjacent ends of the rods, wherein each pivot is separately adjustable in position along the corresponding rod and lockable into its selected position. Preferably each pivot comprises a sleeve slidably arranged around one of the rods and hinged to one end of the connecting member, each sleeve being lockable in position along its corresponding rod by a screw. The ends of the rods remote from the spring are pressed together by the exerciser, who may select the resistance afforded by the spring, and to some extent the directional characteristics of the spring, by moving the sleeves in the same direction, or in opposite directions, to any desired position along the rods. The device can also be folded compactly into a position in which the rods and connecting member are substantially parallel and adjacent to each other.

2 Claims, 1 Drawing Figure

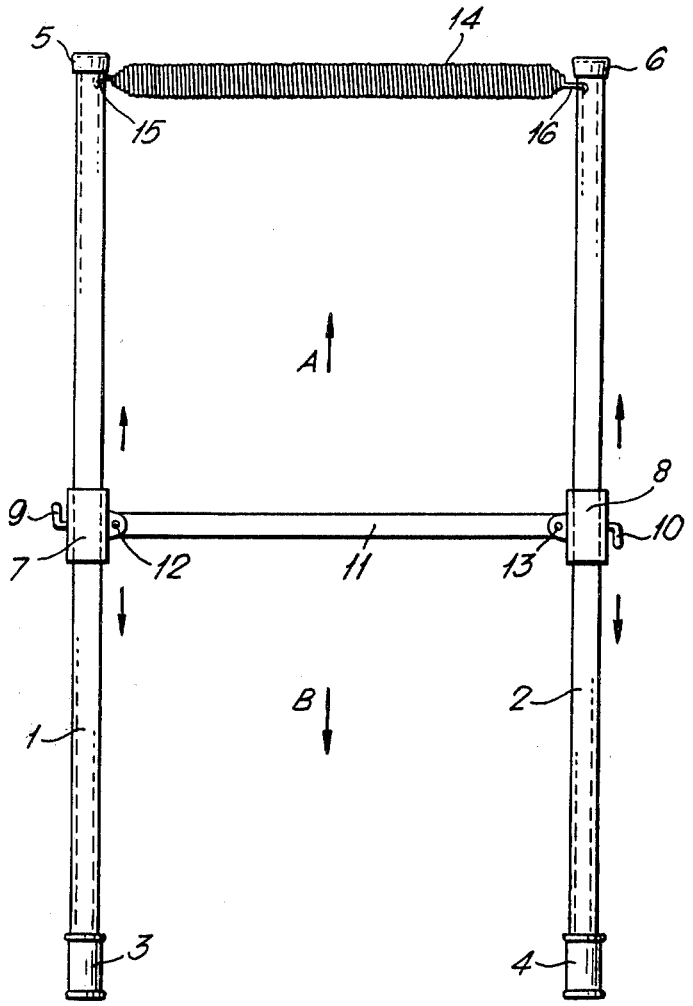
5
14
6
15
16
A
8
9
10
7
12
11
13
B
2
1
3
4

EXERCISING DEVICE

The present invention relates to an exercising device comprising two rods each rod being pivotally connected with an end of a connecting member, and a spring being provided between said rods at one of the rod ends.

The German Pat. No. 430,027 of Ludwig Meyer, issued 12 June 1926, discloses an exercising device (muscle strengthener) comprising two levers having handles at one end and a tensioning spring interconnecting said levers at the other end. At a distance from said other end the levers are pivotally connected by a transverse rod.

This known device provides a firm non-adjustable resistance when said handles/levers are urged towards each other. Thus, said device is not easily adaptable to varying muscle strength and it is, furthermore, only suitable for developing certain arm muscles.

The U.S. Pat. No. 2,529,347 of Stanley R. Mohler and Silas E. Ross, issued Nov. 7, 1950, discloses a device comprising two relatively rotatable levers pivotally connected in one point. Otherwise said device is quite similar to that disclosed in the German Pat. No. 430,027. The resistance of this device against urging said handles towards each other is adjustable by displacing the point of attachment of the tension spring. A disadvantage of said known device is that the possibility of individual exercises is quite limited. Also, it is impossible to collapse this device to a compact assembly.

It is an object of the present invention to provide an exercising device where said disadvantages are eliminated in a simple and inexpensive manner, and the features characterizing the invention are stated in the claims.

In the figure of the drawing, reference numbers 1 and 2 represent tubes 1 and 2 to the ends of which end-sleeves 5 and 6 respectively and handles 3,4 respectively are attached. A tension spring 14 is secured to the ends of tubes 1 and 2 respectively by the end sleeves 5, 6. The tension spring 14 is secured to the tube ends e.g. through holes 15 in the tube ends or e.g. by securing members 16 in the form of a clip or the like. On the tubes 1 and 2 a slider 7,8 respectively in the shape of a cylindrical sleeve or the like is provided slidably and lockably. Said sliders 7,8 are variably lockable on tubes 1,2 respectively by the aid of an angle screw or the like represented by reference number 9 and 10 respectively. A connecting member 11 es provided between the rods 1 and 2 and are hinged to said sliders 7,8 by hinges 12 and 13 respectively.

The exercise device according to the invention can easily be adapted to the desired muscle strength or special exercises by displacing both sliders in the direction A or B or by displacing one or the other slider in the direction A and one or the other slider in the direction B. Thus, the device according to the invention has a wide range of application in contrast with the known exercising devices. As will appear from the figure, the exercising device is easily collapsible and is not bulky. In a collapsed state the connecting member 11 will thus extend practically in parallel with the tubes 1,2.

Within the scope of the following claims modifications can obviously be made as regards the mutual lengths of tubes 1,2 and the connecting member 11, the strength of the springs and their length as well as the choice of suitable materials.

I claim:

1. An exercising device comprising a pair of rods, a connecting member, a pair of pivot means each pivotably connecting one of the opposite ends of said connecting member to a corresponding one of said rods, and spring means joining said rods to each other at one of their ends, characterized in that each of said pivot means is separately displaceable along substantially the entire length of its corresponding rod.

2. The device of claim 1, wherein each of said pivot means comprises a sleeve member hinged to an end of said connecting member, said sleeve member being slidable along the length of one of said rods and lockable in any selected position therealong.

* * * * *